US007155771B2

(12) United States Patent
Re

(10) Patent No.: US 7,155,771 B2
(45) Date of Patent: Jan. 2, 2007

(54) IMPLEMENT WITH BLADE AND SPONGE FOR CLEANING GLASS SHEET

(75) Inventor: Giovanni Re, Milan (IT)

(73) Assignee: F.LLI RE S.p.A., Rho (IT)

( * ) Notice: Subject to any disclaimer, the term of this patent is extended or adjusted under 35 U.S.C. 154(b) by 521 days.

(21) Appl. No.: 10/384,712

(22) Filed: Mar. 11, 2003

(65) Prior Publication Data

US 2003/0167586 A1 Sep. 11, 2003

(30) Foreign Application Priority Data

Mar. 11, 2002 (IT) ..... MI20020013 U

(51) Int. Cl.
*A47L 1/06* (2006.01)
*A47L 13/11* (2006.01)
*A47L 13/12* (2006.01)

(52) U.S. Cl. ..... 15/121; 15/244.1; 15/245

(58) Field of Classification Search ..... 15/121, 15/245, 244.1, 117, 114, 105, 245.1, 236.02
See application file for complete search history.

(56) References Cited

U.S. PATENT DOCUMENTS 1,120,780 A * 12/1914 Ziegler ..... 15/244.1
2,587,382 A * 2/1952 Pyne ..... 401/139
3,837,747 A * 9/1974 Seymore ..... 401/25
4,107,812 A * 8/1978 Lantto ..... 15/245
4,409,700 A * 10/1983 Sullivan ..... 15/121
5,536,095 A 7/1996 Diamond
5,809,605 A 9/1998 Gringer

FOREIGN PATENT DOCUMENTS

| | | |
|---|---|---|
| DE | DE 38 34 301 | 4/1990 |
| DE | DE 93 13 490 | 2/1994 |
| DE | DE 42 28 039 | 3/1994 |
| JP | JP 2002-017618 | 1/2002 |

* cited by examiner

*Primary Examiner*—Gary K. Graham
(74) *Attorney, Agent, or Firm*—Young & Thompson

(57) ABSTRACT

An implement with blade (11) and sponge (12) for cleaning glass sheet, in which the sponge (12) is coupled to the implement by the undercut engagement (9A) of a part of it in a seat (9) of the implement.

7 Claims, 2 Drawing Sheets

IMPLEMENT WITH BLADE AND SPONGE FOR CLEANING GLASS SHEET

BACKGROUND OF THE INVENTION

The present invention relates to an implement provided with a blade and sponge for cleaning glass sheet, such as in windows, in motor vehicles and the like.

DESCRIPTION OF THE RELATED ART

Various types of implement intended for the stated use are known. One type comprises a metal support body grippable by the user, to which there are connected:

a) a sponge provided with its own support, b) a rubber blade; and c) a connection element which enables the two components (sponge and blade) to be fixed to the grippable support body.

The negative aspect of this known type of implement lies in the relatively large number of constituent parts with consequent possibly high production costs and times.

Another known type of implement comprises a grippable plastic support body to which both a sponge and the blade are connected and locked by a cover element. Again, as in the case of the preceding implement, the relatively large number of parts can result in relatively high production costs and times.

SUMMARY OF THE INVENTION

An object of the present invention is to provide a glass sheet cleaning implement provided with a blade and sponge which is composed of a small number of parts and is designed to satisfy ergonomic requirements during its use.

Another object of the present invention is to provide a glass sheet cleaning implement provided with a blade and sponge, which is particularly lightweight and therefore does not produce fatigue during prolonged constant use, and is particularly robust especially with regard to the rigidity of the connection between the grippable support body and the blade and sponge.

These and other objects which will be apparent from the ensuing detailed description are attained by a glass sheet cleaning implement in accordance with the technical teachings below.

BRIEF DESCRIPTION OF THE DRAWINGS

The invention will be better understood from the following detailed description, provided by way of non-limiting example, of one embodiment thereof illustrated in the accompanying drawings, in which.

DESCRIPTION OF THE PREFERRED EMBODIMENTS

Figure 1:
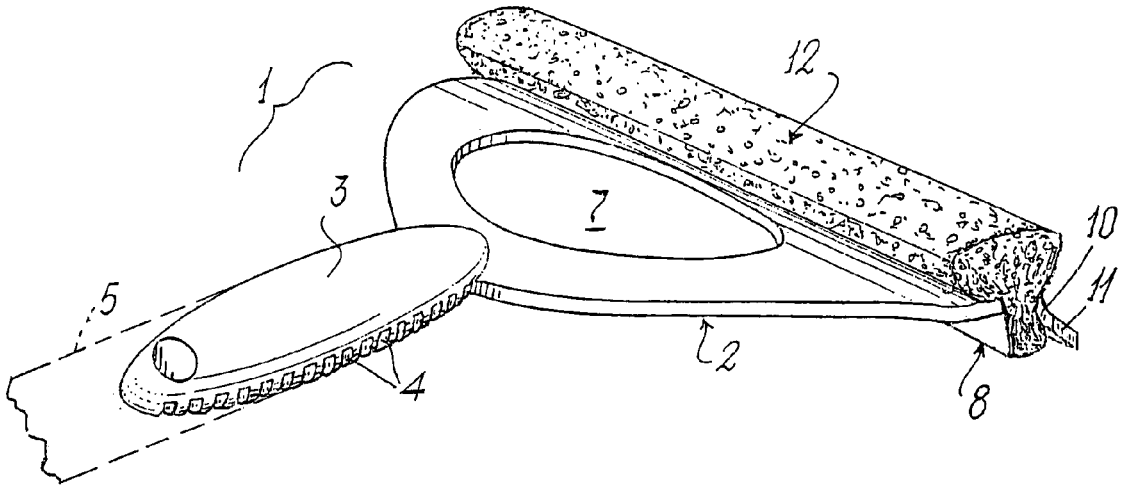
FIG. 1 is a perspective view of the implement of the invention.
Figure 2:
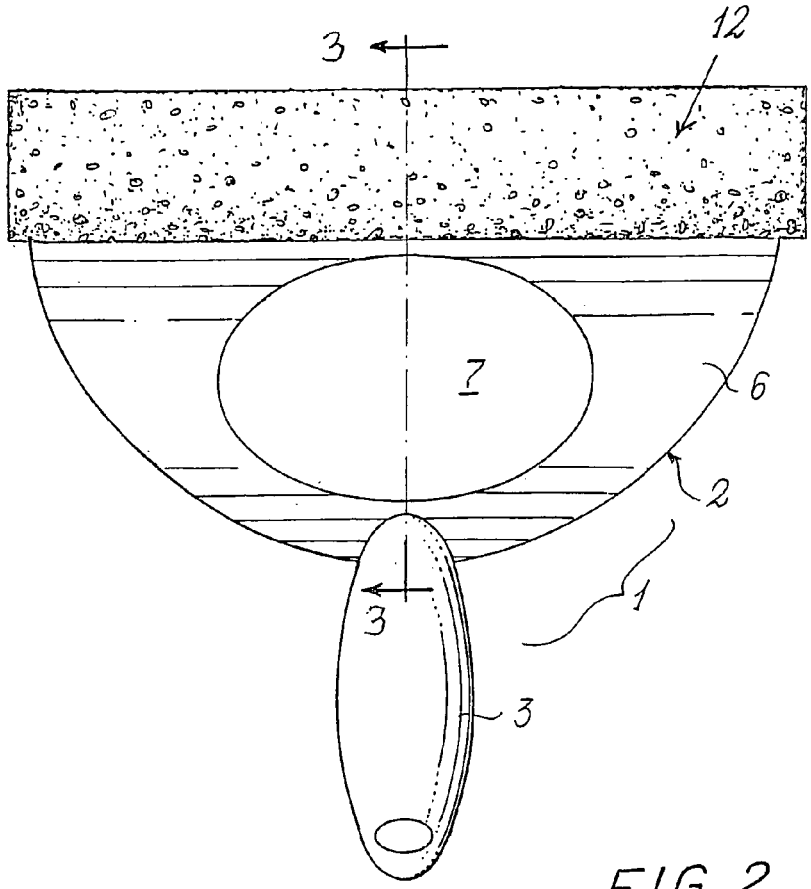
FIG. 2 is a view of the invention taken from above.

In the figures, the reference numeral 1 indicates overall the glass sheet cleaning implement formed in accordance with the teachings of the present invention.

The implement comprises a plastic support body 2 provided integrally with a handgrip 3 lightened by transverse slots 4, these slots also improving the gripping effect of the user's hand. To enable the implement to be used in points or regions of the glass which are distant from the user, the suitably shaped end of an extension rod 5 can be forced onto the handgrip, which can be long or short.

The support body 2 presents an intermediate arcuate part 6 provided (to lighten the implement) with one or more apertures 7. At that end distant from the end comprising the handgrip 3, the support body 2 presents a transverse extension 8, which defines a seat 9 for receiving and fixing a part of one and the same sponge 12, and comprises a prolongation 10 which terminates in a co-moulded transverse blade of rubber or similar material.

Figure 3:
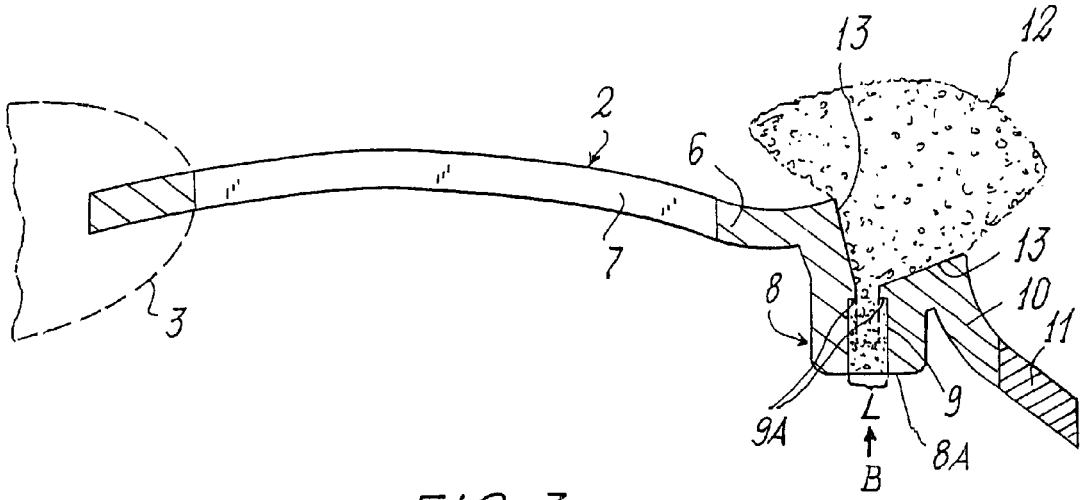
FIG. 3 is a section on the line 3—3 of FIG. 2, on a different scale.
Figure 4:
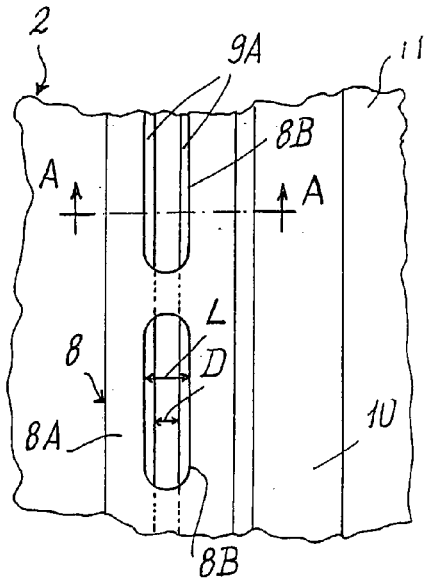
FIG. 4 is a partial view in the direction of the arrow B of FIG. 3, on a different scale.

Of particular constructional and functional importance is the method by which the sponge 12 is fixed to the body 2 without the need to use special pieces or components. The method in question is the following: The seat 9 is a slot which extends along the entire length of the extension 8 and is provided along predetermined portions with undercuts 9A, the main purpose of which is to retain that part of the sponge which is forced into the seat 9, where it expands to prevent sponge extraction (separation). The undercuts are obtained without the need to use complex moulds (i.e. which undergo movement). In this respect, in the base wall 8A of the transversal extension 8 there are provided several longitudinal aligned windows 8B, the width L of which (see FIGS. 3 and 4) is greater than the longitudinal aperture D bounded by the facing undercuts 9A in correspondence with the windows 8B, through which aperture D the coupled part of the sponge 12 is forced and inserted (into the seat 9).

The aperture D opens at two surfaces 13 which form a contained angle preferably of 70–90° and against which the regions of the sponge rest, their purpose being to counteract excessive transverse mobility of the sponge during use.

Essentially, the implement of the present invention is composed of only two pieces to be fitted together, i.e. the sponge 12 and the support body 2 of which the blade 11 forms an integral part, as it is co-moulded therewith.

The invention claimed is:

1. An implement with a blade (11) and a sponge (12) for cleaning a glass sheet, characterised in that the sponge (12) is coupled to the implement by an undercut engagement (9A) of a part of the sponge in a seat (9) of the implement, wherein the seat (9) is present in a transverse extension (8) of the implement and is formed from undercut portions (9A) spaced apart by other portions which are not undercut, the undercut portions being present in correspondence with spaced-apart aligned windows (8B), the width (L) of which is greater than the width (D) of the undercut (9A).

2. An implement as claimed in claim 1, wherein, the seat (9) receives and fixes the part of the sponge (12) and comprises a prolongation (10) which terminates in the blade (11), and the blade is co-moulded to the prolongation (10).

3. An implement as claimed in claim 1, wherein resting and counteracting surfaces (13) are provided for the sponge (12), said surfaces lying at an angle apart which is preferably between 70° and 90°.

4. An implement as claimed in claim 1, wherein to the transverse extension (8) there is connected a prolongation (10), at the end of which the blade (11) is co-moulded.

5. An implement as claimed in claim 1, wherein the implement is arcuate and lightened by at least one aperture (7), and is provided integrally with a handgrip (3) which can be coupled to an extension (5).

6. An implement as claimed in claim 1, which is composed of two parts, one formed from an implement body (2) which is integral with the blade (11), and one formed from the sponge (12) which is undercut-engaged with said body.

7. An implement as claimed in claim 1, characterised by being constructed of synthetic material or materials.

* * * * *